US005779110A

United States Patent [19]

Brown et al.

[11] Patent Number: 5,779,110

[45] **Date of Patent: *Jul. 14, 1998**

[54] PACKAGE HAVING CLOSURE ASSEMBLY WITH CONCEALED HINGE

[75] Inventors: John J. Brown, Park Ridge; Michael F. Jacobs, McHenry, both of Ill.

[73] Assignee: Courtaulds Packaging, Inc., Arlington Heights, Ill.

[ * ] Notice: The term of this patent shall not extend beyond the expiration date of Pat. No. 5,400,912.

[21] Appl. No.: 412,184

[22] Filed: Mar. 28, 1995

Related U.S. Application Data

[63] Continuation-in-part of Ser. No. 60,093, May 10, 1993, Pat. No. 5,400,912.

[51] Int. Cl.[6] ..... B65D 41/32; B65D 47/00

[52] U.S. Cl. ..... 222/556; 215/237; 215/238; 220/339; 222/517; 222/546

[58] Field of Search ..... 222/546, 556, 222/498, 517; 215/235, 237, 238; 220/337, 339

[56] References Cited

U.S. PATENT DOCUMENTS

| | | | |
|---|---|---|---|
| 3,651,992 | 3/1972 | Hazard | 222/556 X |
| 4,782,985 | 11/1988 | Kinsley | 222/556 X |
| 4,801,054 | 1/1989 | Nycz | 222/556 X |
| 4,815,616 | 3/1989 | Silvenis | 222/517 X |
| 4,911,324 | 3/1990 | Dubach | 222/556 X |
| 5,067,624 | 11/1991 | Thanisch | 222/556 X |
| 5,083,671 | 1/1992 | Hayes | 215/235 X |
| 5,213,235 | 5/1993 | Miranda | 222/556 X |
| 5,392,938 | 2/1995 | Dubach | 222/556 X |
| 5,400,912 | 3/1995 | Brown etal. | 222/556 X |

FOREIGN PATENT DOCUMENTS

| | | | |
|---|---|---|---|
| 2749946 | 5/1978 | Germany | 222/517 |

*Primary Examiner*—Kevin P. Shaver
*Attorney, Agent, or Firm*—Baker & McKenzie

[57] ABSTRACT

A package including a container assembly, such as a tube having a dispenser spout, and a closure assembly having a concealed hinge, is provided for use in dispensing a consumer product such as toothpaste or medicinal ointment. The concealed hinge of the closure assembly permits a lid to be opened up to 180° away from an associated closure base to provide maximum access to the container assembly to which the closure assembly is assembled. The closure assembly, including the lid and base, is capable of being molded in a single mold cavity and having maximum ease of opening and closing together with either one or two seals.

13 Claims, 5 Drawing Sheets

Fig. 6.
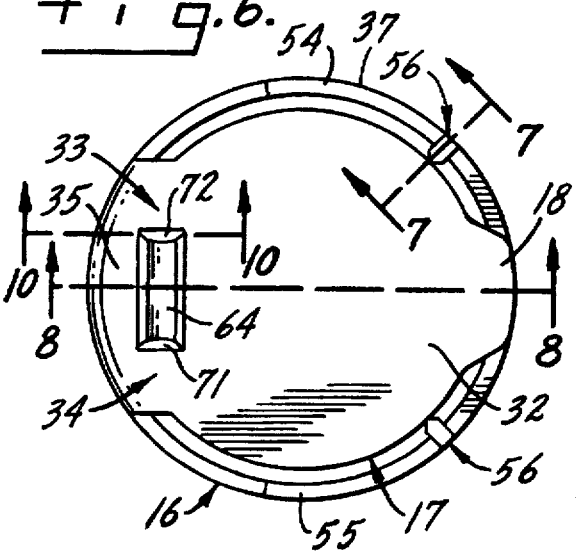
Fig. 7.
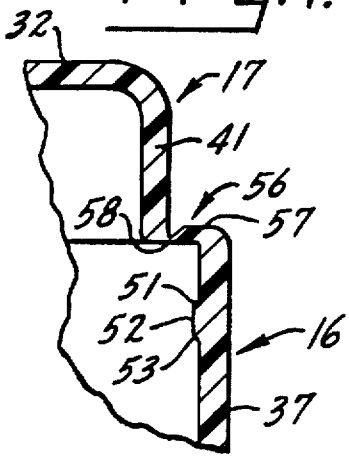
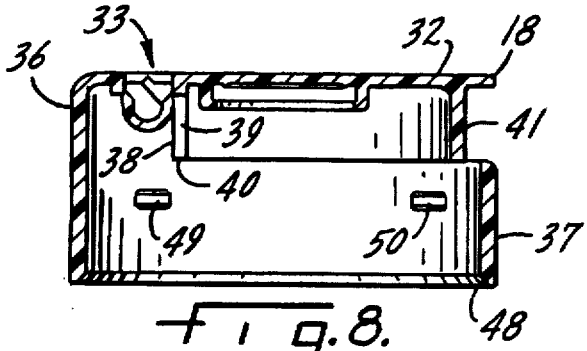
Fig. 8.
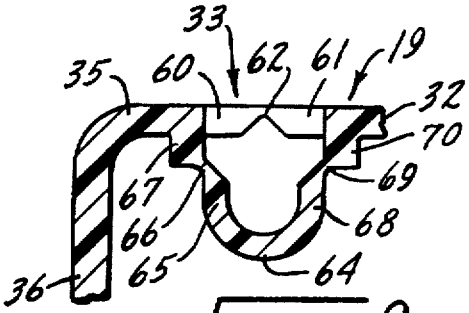
Fig. 9.
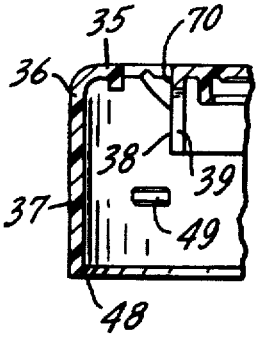
Fig. 10.
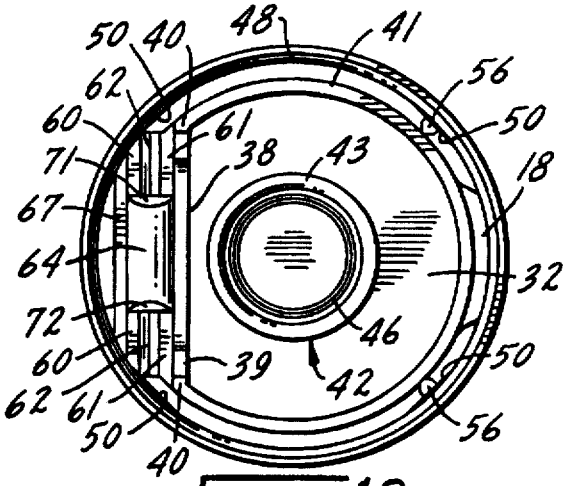
Fig. 12.
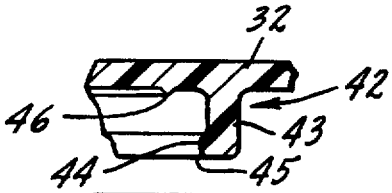
Fig. 11.
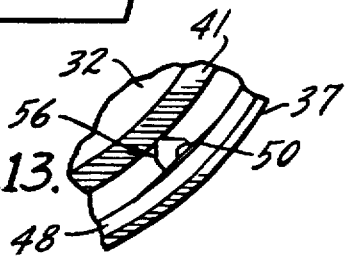
Fig. 13.

Fig.16.
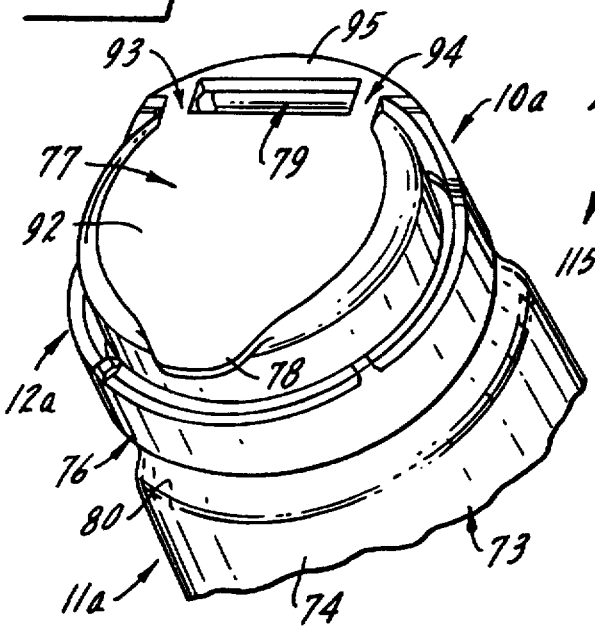
Fig.17.
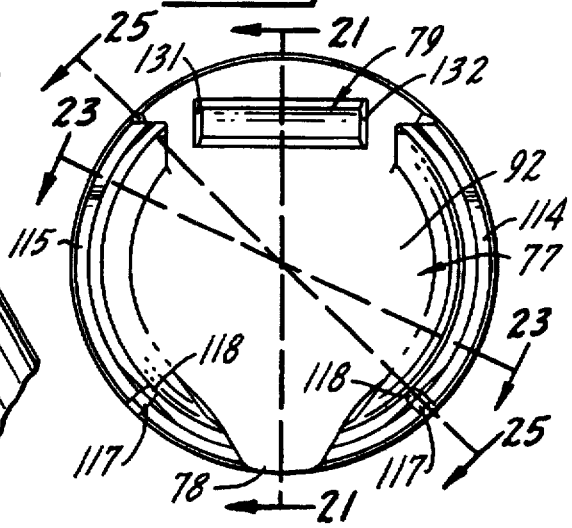
Fig.18.
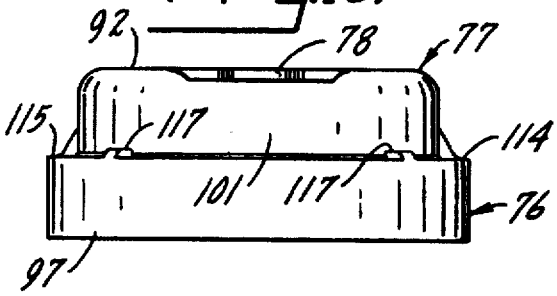
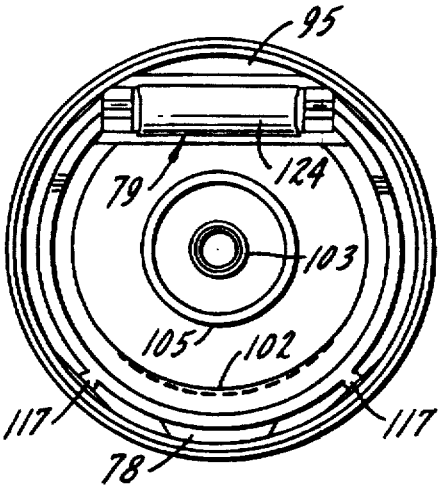
Fig.19.
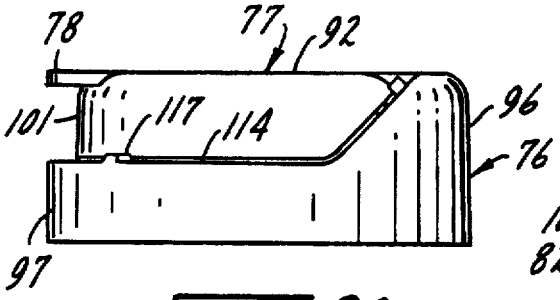
Fig.20.
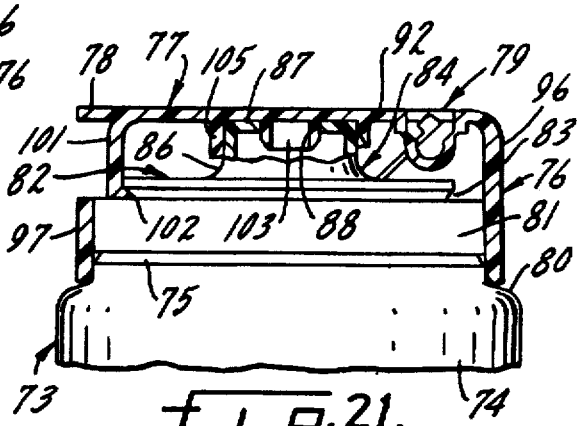
Fig.21.

PACKAGE HAVING CLOSURE ASSEMBLY WITH CONCEALED HINGE

This is a continuation-in-part of application Ser. No. 08/060,093, which was filed on May 10, 1993, and issued as U.S. Pat. No. 5,400,912 on Mar. 28, 1995.

This invention relates generally to a package consisting of a closure assembly and a container assembly in which the closure assembly has a concealed hinge. The invention specifically includes a dispensing type closure adapted for use on a container, such as a tube, which includes a dispensing spout, the closure being so constructed as to be capable of being molded in a closed position and to be opened 180° to thereby provide maximum access to its associated container.

BACKGROUND OF THE INVENTION

Packages, which for purposes of the following description are defined as the combination of a closure assembly and a container assembly (such as a tube), are often purchased by the consumer on the basis of the convenience, or perceived convenience, of the closure assembly portion thereof. As a consequence much development effort has been devoted to closure assemblies, the goal being to provide a closure assembly which is efficient, easy to use and, most importantly from the manufacturer's point of view, economical to produce and assemble to an associated container assembly. Particular effort has been directed to packages in which the closure assembly includes a dispensing spout since a very large number of very different products can be conveniently dispensed from a dispensing spout including highly viscous cosmetic fluids and industrial grease of very low viscosity.

All, or at least the very great majority, of current dispensing closures are molded in the open position or in two or more pieces. Closures molded open must be closed prior to capping. This extra step can be accomplished through post-mold closing equipment, or in-mold closing equipment. Either step adds cost to the process by requiring extra equipment. In addition, in-mold closing requires a longer molding cycle time and therefore a higher piece price cost.

Closures molded in the open position require twice as much tool space as closures molded in the closed position. Therefore, for a given tool size, a mold can contain twice as many cavities of molded closed closures, compared to molded open closures. This reduces the tool cost per cavity.

In addition, most molded open dispensing closures when capped onto an associated container and which require a tamper resistancy feature so as to protect against unintentional opening, use shrink wrap or a separate box to achieve this additional feature. The shrink wrap or a separate box increases the cost of manufacture of the final package in that an extra operation, separate and distinct from the molding operation in which the closure is formed, is required. And, of course, the cost of acquiring and providing equipment for a separate raw material is also required. Included in the cost of using a shrink wrap or separate box is the additional machine time necessary to apply a wrap or enclose the component within a box.

Most, if not all, conventional dispensing closures with living hinges have non-uniform peripheries due to hinge protrusions. As a consequence, the protruding hinge tends to cause interference during the assembly and handling phases of production. When the closures are fed to the capping equipment, for example, preparatory to being secured to a tube, the peripherally outwardly extending protrusions can be the cause of jam-ups in the closure feeding mechanism and consequent line down time while the jammed closures are freed and the feed line restarted. In addition, closures with protrusions are often not well adapted for inverted packaging and can be of concern with respect to consumer handling safety.

In addition, many dispensing closures are fastened to their associated package by threads. Threads require torquing type capping equipment which, on occasion, results in packages with non-oriented closures. Although such a filled tube may, from a technical standpoint, operate substantially as efficiently as one having the desired dead center alignment, as a practical matter the consumer tends to avoid purchasing such an out of alignment product, often on the assumption that there is something "wrong" with the product. In addition, torque type capping equipment is more costly than other types of capping equipment such as snap-on type capping equipment. Even the molds for screw-on type closures are more expensive than, for example, snap-on closures since screw-on molds usually require an unscrewing core or a collapsible core and, in general, are more complex and expensive than snap-on closure molds.

A further drawback with many current closures is that such closures almost invariably have a protruding tab in order to enable a user to quickly and conveniently locate the "handle" formed by the tab for easy opening and closing of the product. When a protruding tab extends outwardly beyond the outer diameter of the base of the closure, interference in the capping process and in the automatic handling of the closure can occur.

Raised orifice spouts are an advantage to the consumer because of their distance from the conventional deck of the closure. An orifice flush with the deck of the closure can be harder to clean than a raised orifice, and a raised orifice spout gives the consumer a greater angled view to the orifice than a flush orifice. Thus a dispensing closure which will accommodate raised orifices of substantial heights is a distinct advantage over a package which includes a flush orifice.

It is also important that the spout access area be as large as possible. This is particularly important in closures in which the hinge structure is located within the periphery of the closure. It will be understood that in a closure in which the hinge structure is located within the periphery of the closure; that is, no part of the hinge member protrudes outwardly beyond the periphery of the lid, a portion of the lid area must necessarily be dedicated to the hinge structure. In this invention the lid area which is necessarily dedicated to the hinge mechanism is made very small and as close to the periphery of the lid as possible to thereby provide the maximum possible access area to the spout. A further requirement is that the lid be easy to flip open and close since such containers are intended, primarily, for the consumer market. Further, the lid should be easily opened and closed to quickly present the spout, and the spout area, to the user in the sense of no binding engagement, or interference, of the parts which come in contact with one another during the opening and closing movements.

In addition, a raised spout also makes possible the application of a foil "freshness" seal applied to the top of the spout. Such a seal provides a measure of tamper resistancy, as well as retaining the integrity of seal of the package and thus the freshness (moisture and oxygen barrier) of the product.

It is also desirable that the closure be capable of providing a single seal or a double seal of the spout. It will be understood that a double seal may be highly desirable when the container with which the closure is associated holds and dispenses liquids of high viscosity.

It is also highly desirable that the closure be capable of be capable of being positively and audibly locked when not in a dispensing condition so that the user is informed that the closure is fully closed and the sealing means made operative.

And finally, all, or nearly all, conventional closures include, as a necessary feature, a closure deck. Such a deck requires a substantial quantity of material which, since most such closures are manufactured from good quality resins, comprises a significant item of cost.

SUMMARY OF THE INVENTION

The invention includes (i) a concealed hinge dispensing closure which can be molded in a closed position, (ii) a tamper resistancy feature which is added in the molding process, (iii) has a lid with a lifting and closing tab which does not extend beyond the periphery of the closure, (iv) is assembleable to a dispensing container by a snap-on process, (v) is of any desired height so as to be usable with a container having a dispensing spout of substantial height, (vi) has a spout access area of maximum or near maximum area permissible with a hinge mechanism located within the periphery of the lid, (vii) has a lid which is easily flipped open and closed by the user, (viii) is adaptable to both single seal and double seal containers, (ix) does not bind during opening or closing regardless of whether a foil seal system, a peripheral sealing system or a single or dual plug seal system comprises the sealing means, (x) be capable of being positively locked when not in use, and (xi) does not require a closure deck in any of its iterations. As a consequence, the molding costs of the closure are lower than conventional closures because a mold can contain twice as many closure cavities as a molded open closure mold, and the cycle time is less. Safety tabs can be formed during the molding process thereby eliminating later, and more costly, applications of shrink wraps and cardboard, with a consequent decrease in excess packaging which must be thrown away upon initial use.

Further, the closure, due to a uniform periphery wherein neither hinges nor open-close tabs protrude beyond the periphery, is well adapted to be used in automatic assembly and handling equipment, and, since the closure may be snapped onto an associated container, the less costly snap-on type capping equipment can be used.

A distinct advantage over many conventional closure systems is that the present design permits the deck and spout of the conventional closure to be transferred, in effect, to the tube head thus greatly simplifying the design of the closure and reducing its cost, possibly without a significant increase in the cost of the tube. And since the closure does not contain a closure deck, less material is required in the closure than in similar type closures. Even though no closure deck is used, the closure can be of substantial height so that the container can include a raised orifice spout of any desired height.

BRIEF DESCRIPTION OF THE DRAWING

The invention is illustrated, more or less diagrammatically, in the accompanying drawing in which:

FIG. 6 is a top plan view of the dispensing closure assembly of this invention;

FIG. 7 is a partial section view taken substantially along the line 7—7 of FIG. 6 but to a larger scale than shown in FIG. 6;

FIG. 8 is a section view taken substantially along the line 8—8 of FIG. 6 and showing the closure assembly in a fully closed position;

FIG. 9 is a detail view of the hinge section of FIG. 8 to a larger scale;

FIG. 10 is a view taken substantially along the line 10—10 of FIG. 6;

FIG. 11 is a detail view of the fastener portion of the dispensing closure;

FIG. 12 is a bottom plan view of the dispensing closure assembly;

FIG. 13 is a detail view to an enlarged scale of the gripper means for maintaining the base of the closure to the tube/bottle neck finish and additionally a view of the tamper resistant cover and base of the dispensing closure assembly in spaced, tamper resistancy position with respect to one another prior to the first use by a user;

FIG. 16 is a perspective view of an alternative embodiment of the invention showing a package consisting of a closure assembly and the upper, exterior portion of a container assembly;

FIG. 17 is a top plan view of the closure assembly of the alternative embodiment;

FIG. 18 is a front view of the closure assembly of the alternative embodiment;

FIG. 19 is a bottom view of the closure assembly of the alternative embodiment;

FIG. 20 is a left side view of the closure assembly of the alternative embodiment;

FIG. 21 is a view, partially in section, taken substantially along the line 21—21 of FIG. 17;

DESCRIPTION OF SPECIFIC EMBODIMENT

Figure 1:
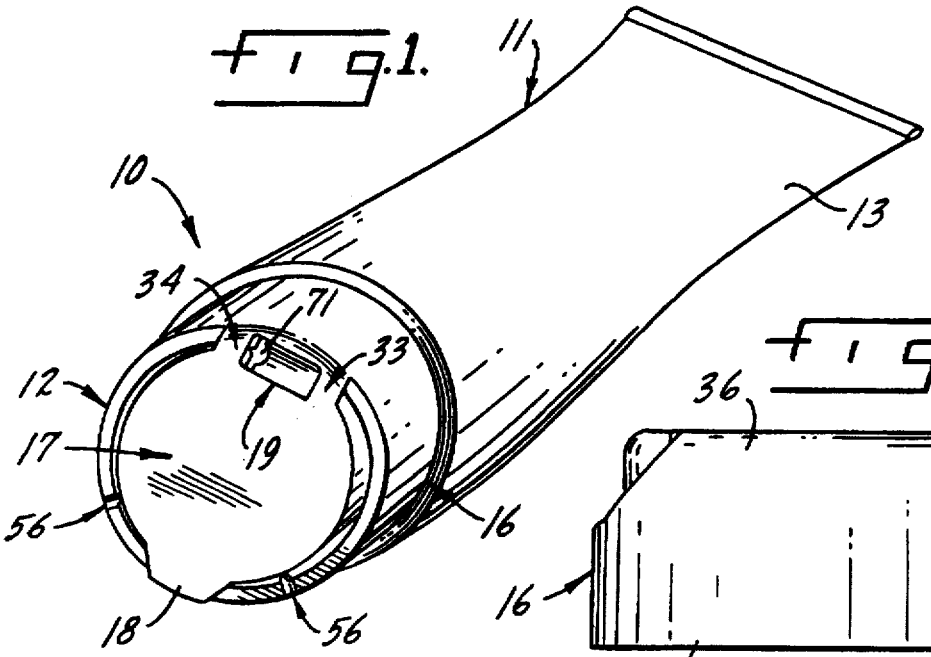
FIG. 1 is a perspective view of a dispensing package, using a tube for illustration, in which the unique dispensing closure assembly of this invention has been incorporated.
Figure 3:
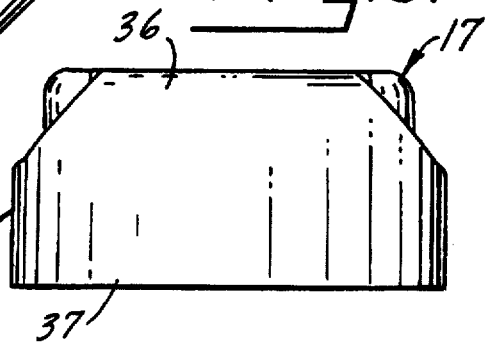
FIG. 3 is a rear view of the closure assembly of this invention.
Figure 4:
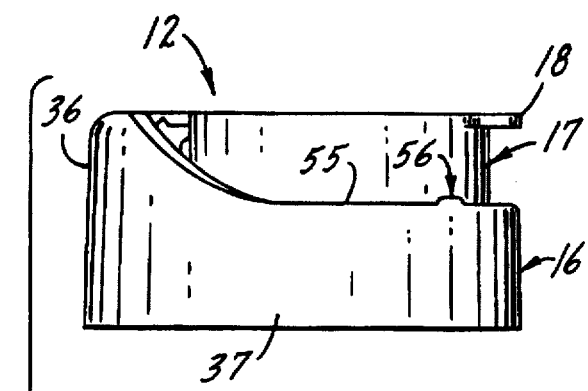
FIG. 4 is a similar rear view with portions broken away.
Figure 4:
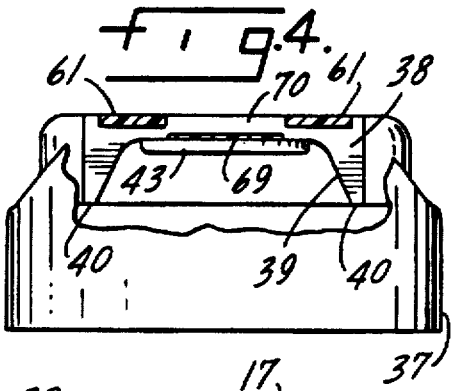

Like reference numerals will be used to refer to like or similar parts from Figure to Figure in the following description of the drawing.

Referring to FIG. 1 a package is indicated at 10, the package consisting of a container assembly, indicated generally at 11, and a closure assembly, indicated generally at 12. It will be understood that the product contained within the container assembly 11 may vary widely from automotive grease to medicinal ointments. For convenience of description, it will be assumed that a typical consumer product, such as toothpaste, is the product to be stored and dispensed at the will of a user. It should be understood, however, that reference to toothpaste is for convenience only and is not to be taken as limiting the scope of the invention. The container assembly 11 includes, in this instance, a tube structure 13 which is closed at one end, as by crimping. The closure assembly 12 includes a closure base, indicated generally at 16, and a closure lid, indicated generally at 17. A lift tab, which is part of the closure lid, is indicated at 18, and a hinge assembly which connects the lid to the base is indicated at 19.

Figure 2:
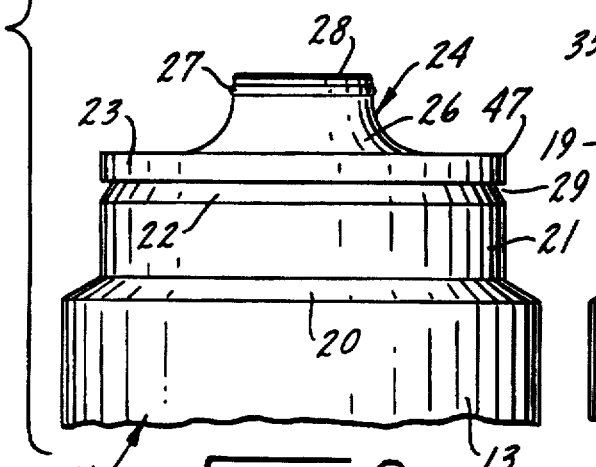
FIG. 2 is an exploded elevation of the top end portion of a typical container assembly with which the dispensing closure assembly of this invention is intended to be used, and the dispensing closure assembly of this invention.

Referring now to FIG. 2 the closure assembly 12 is shown exploded away from the container assembly 11. The tube structure 13 includes an inwardly and upwardly inclined lower transition section 20, a top section 21 whose outer diameter is sized to be received within the closure base 16 as will be described in detail hereinafter, an upper inwardly and upwardly inclined transition section 22, and a tube deck 23 from which a pouring or dispensing spout structure, indicated generally at 24, extends upwardly. The top section 21, transition section 22 and tube deck 23 are all known as the "neck finish" and that term will be used from time-to-time hereinafter. The spout structure includes a neck portion 26 which has an eye-pleasing upwardly curved contour, a peripheral bead 27 and, in this instance, a conventional foil safety seal 28. It will be noted that the tube deck 23 side walls overhang the upper surface of the upper transition section 22 to form an annular indentation 29 or indent ring for a purpose which will appear hereinafter.

Figure 5:
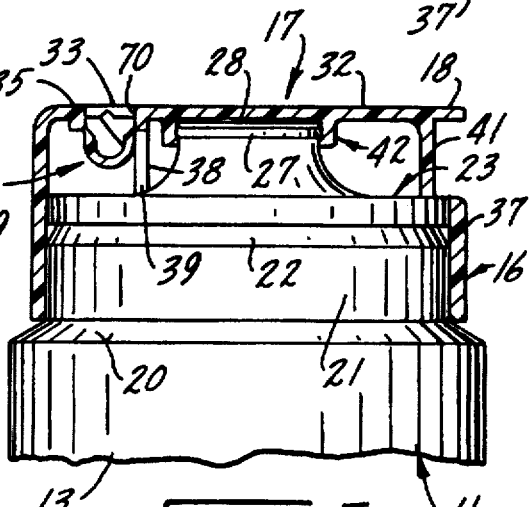
FIG. 5 is a side view in partial section of the dispensing closure assembly of this invention assembled to a tube.

Referring now to FIG. 5 the relationship of the closure assembly 12 to the container assembly 11, and specifically the upper end portion of the container assembly 11, is illustrated in greater detail.

The closure lid 17 includes a central, generally circular top plate 32 (see also FIG. 6) which moves from the closed position of FIGS. 5 and 6 to the fully opened position of FIG. 15, as will be described hereinafter. The lift tab 18 is integral with top plate 32. The top plate 32 is connected by the hinge assembly 19, which includes hinge plates 33, 34, see FIG. 6 also, to hinge base 35 which in turn is an integral horizontal extension of a vertical extension 36 from the enclosed circular base wall 37, see also FIGS. 3, 4, 6 and 8. The lid and hinge base form a top disposed on the closure base. A reinforcement wall 38 located forwardly of hinge assembly 19 projects downwardly from top plate 32. Wall 38 is cut away as at 39, see FIGS. 4, 5 8 and 10, so as not to interfere with spout structure 24. A lid skirt, which extends approximately 300° about the circumference of the top plate 32 is indicated at 41, see FIGS. 5, 7, 8 and 12.

Fastener means for ensuring that the closure lid 17 remains secured to the tube spout 24 is indicated generally at 42 in FIGS. 5 and 11. The fastener means includes a downwardly projecting circular flange 43 which has an internal bead 44 encircling its lower, inner end. The bead 44 has a curved contour 45 on its lower side so that it will easily cam past the peripheral bead 27 on the spout structure 24 and engage the underside of bead 27 to secure the closure lid to the spout structure 24. A circular downwardly pointed seal ring 46 engages the exposed upper rim surface of the neck portion 26 of the spout after the safety seal 28 has been removed to seal the contents of the tube assembly from ambient atmosphere after the first use by the user, and the removal of the foil seal 28.

Figure 15:
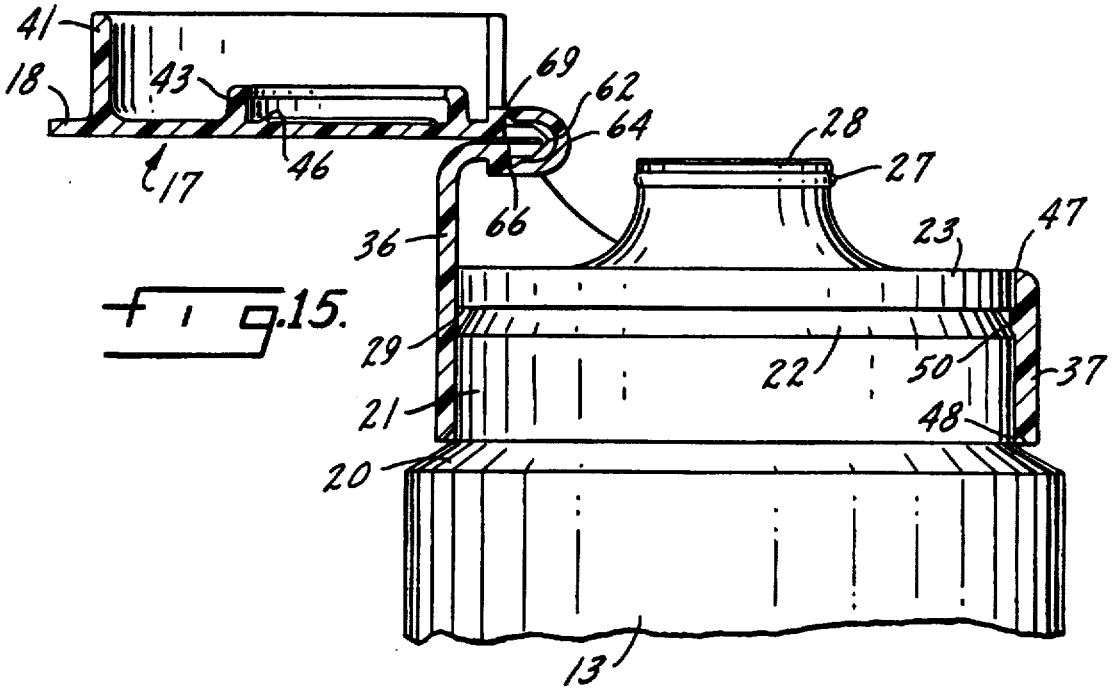
FIG. 15 is a view similar to FIG. 14 but showing the closure in a fully open, or 180°, position.

The means for securing the closure assembly 12 to the container assembly 11 is illustrated best in FIGS. 2, 5, 7, 8, 10 and 15. Referring first to FIG. 15, the inner edge of the base wall 37 is chamfered as at 48 so that when the container assembly 11 and the closure assembly 12 are brought into engagement for securement to one and other, the base wall 37 will contact the upper outer edge 47, see FIG. 2, of the tube deck 23 as the closure assembly moves to its fully engaged position of FIGS. 5 and 15.

Referring now to FIGS. 5, 7, 8 and 10, and to FIG. 8 initially, two of four snap-on lugs are indicated at 49, 50. For purposes of illustration a lug is indicated in FIG. 15 on the right side of the package. Each lug consists of an upper inclined surface 51, see FIG. 7, which could be flat but, as shown, is preferably inclined slightly downwardly and inwardly, a vertical surface 52, and a lower downwardly and outwardly inclined surface 53, the three surfaces forming a projection which is snugly received in the area 29 whose cross section is generally triangularly shaped as shown in FIGS. 5 and 15. It will be noted that the slant of the lower surface 53 matches the slant of the transition section 22 of the container assembly 11, and the upper surface 51 fits slightly under the overhanging edge of the tube deck 23. The upper slanted surface 51 makes possible the removal of the closure assembly 12 from the container assembly 11 with the application of sufficient force exerted between the lower edge of base wall 37 and the lower transition section 20. If the contained product is tooth paste and hence there is little or no foreseeable need to disassemble the closure assembly from the container assembly during the normal life of the package, the upper surface 51 could be flat, though mold design considerations could still indicate the use of the illustrated slanted configuration.

The unique means for molding the package in a closed position is illustrated best in FIGS. 6, 7, 12, 13 and 14.

Figure 14:
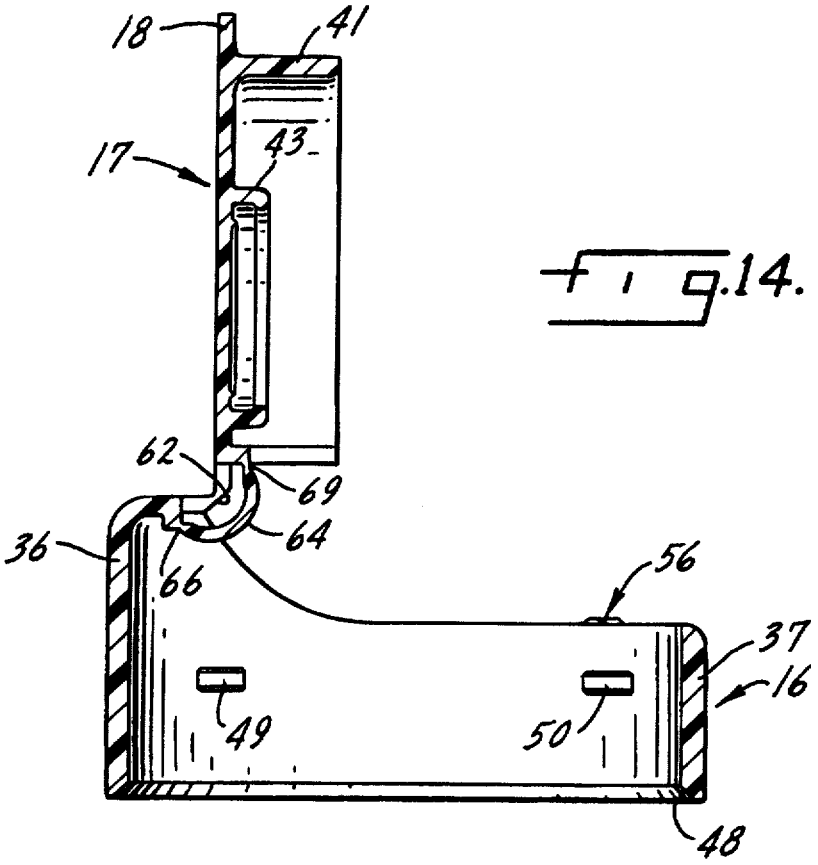
FIG. 14 is a side view partially in section showing the closure assembly in a partially opened position as it moves between fully opened and fully closed positions.

Referring first to FIG. 7, a tamper resistant member which joins the closure lid 17 to the closure base 16 is indicated generally at 56. The tamper resistant feature is a tab which is formed integrally with base wall 37 as best seen in FIGS. 7 and 14. The tamper resistant tab includes a base section 57 which terminates in a thin strap 58 which joins the lower outer edge of lid skirt 41 to base wall 37. The strap 58 may, for example, be on the order of only about 0.006" in thickness and hence it forms a line of weakness which can be readily ruptured by the application of upwardly directed thumb pressure on lift tab 18, yet the tamper resistant tab, of which two are shown in this instance, are sufficiently strong to maintain the closure base 16 and the top plate 32 and its depending lid skirt 41 in the position of FIG. 7 during molding including ejection, and subsequent handling and capping steps. It will be understood that since the top plate 32 is oriented relative to base wall 37 as shown in FIG. 6, engagement pressure for pushing the closure assembly 12 onto the container assembly 11 may be exerted on the upper exposed surface portions 54, 55 of base wall 37, see FIG. 5, and thus little pressure will be exerted on closure lid 17 which would be transmitted to the thin straps 58. As a result, the integrity of the straps 58 is maintained until the user, such as a consumer, prepares to use the package for the first time.

The unique concealed hinge feature of this invention is illustrated best in FIGS. 1, 5, 6, 8–10, 12, 14 and 15.

Referring first to FIG. 9, which is a detailed view of the hinge portion of FIG. 8, but to a larger scale, it will be seen that the upper surface of left hinge plate 33 is flush with the top surface of top plate 32 so that a smooth, aesthetically pleasing appearance is presented to the eye. Since hinge plates 33 and 34 are identical, only hinge plate 33 will be described. This can also be seen from FIGS. 1 and 6. The hinge plate 33 includes a rear portion 60 and a front portion 61, the two portions tapering upwardly at the mid-portion of the hinge plate to define a bend line area 62. It will be understood that the material to the left of bend line area 62 in FIGS. 6 and 8 is integral with, and forms a portion of, hinge base 35, and the material to the right of bend line area 62 is integral with, and forms a portion of, top plate 32.

The hinge assembly 19 includes a U shaped hinge 64 whose rear leg 65 terminates in a thin strap 66 which in turn is integral with depending rear base member 67 which is integral with hinge base 35. The front leg 68 of hinge assembly 19 terminates in a thin strap 69 which in turn is integral with the depending front base member 70 which is integral with the top plate 32. The left end and right end portions of hinge 64 are preferably cut away as at 71, 72, see FIGS. 6 and 12, to relieve any tendency for the hinge assembly to bind as it moves from a fully closed to a fully opened position, and back again.

The closure assembly 12 is illustrated in a fully closed position in FIGS. 5, 8, 9 and 12. This is the position in which the closure assembly is molded and snapped onto container assembly 11 prior to the first use of the package.

In FIGS. 14 and 15, the package has come into the hands of a consumer and it is shown in operation during the first use. In FIG. 14, the user has exerted upward pressure on lift tab 18, usually by a thumb or a finger, or both, and the thin straps 58 of FIG. 7 which held the closure lid 17 spaced from the closure base 16 have been broken so that there is no external restraint to movement of one with respect to the other. The lid 17 is shown in a 90° or half open position in FIG. 14. In this position the hinge 64 has been flattened in contour and the hinge straps 66 and 69, as well as the hinge 64, are under considerable tension. By the same token, the material in the bend line area 62 has been partially extended. It will be understood, however, that since the material from which the closure assembly 12 is made is preferably a thermoplastic material such a polypropylene, and since the bend line area may be on the order of about 0.011" in thickness, the degree of deformation represented by the half open position of the FIG. 14 may be easily attained.

In FIG. 15, the closure 17 is in the 180° or fully opened position. In this condition the rear and front straps 66 and 69 of the hinge have had the tension represented by FIG. 14 relieved, and these straps are therefore under no tension. However, bend line area 62 is at maximum extension and tension but, as indicated in FIG. 15, the tension in bend line area 62 and straps 66 and 69 which tends to urge the closure 17 back to the position of FIG. 8 is insufficient to overcome the counterpressure of hinge 64 which tends to remain in its as molded position of FIG. 9. As a consequence, the closure 17 remains in a 180°, fully open position thereby providing maximum access, during use, to the spout 26.

It will be noted in FIGS. 5 and 15 that the container assembly 11 is shown in its condition as manufactured and up to the moment before the user seeks initial access to the contents of tube structure 13. In this position the foil safety seal 28 remains intact and hence the user can tell at a glance prior to first use whether the package 10 has been tampered with to the extent that the contents of tube structure 13 has been accessed. During the first use, the user will, of course, remove the foil safety seal 28 in any appropriate manner, such as by breaking with a finger and tearing around the periphery or lifting off by a suitable tab which is integral with the seal.

Referring now to the alternative embodiment of FIGS. 16–27 a package is indicated generally at 70, the package consisting of a container assembly, indicated generally at 71, and a closure assembly, indicated generally at 72. It will be understood that the product contained within the container assembly 71 may vary widely in characteristics and viscosity. For convenience of description it will be assumed that a typical consumer product, such as a cosmetic liquid of high viscosity, is the product to be stored and dispensed at the will of a user. It should be understood however that reference to a highly viscous cosmetic fluid is for convenience only and is not to be taken as limiting the scope of the invention; the container assembly could just as well contain automotive axle grease of very low viscosity. The container assembly includes, in this instance, a tube structure 73 which is closed at one end, as by crimping. The closure assembly 72 includes a closure base, indicated generally at 76, and a closure lid, indicated generally at 77. A lift tab, which is formed integrally with the closure lid 77, is indicated at 78, and a hinge assembly which connects the lid to the base is indicated at 79.

Referring now to FIGS. 16 and 21, and particularly to FIG. 21, the tube structure 73 includes a barrel portion 74, an upwardly and inwardly inclined transition section 80, another upwardly and inwardly inclined transition section 75, and a top section 81 whose outer diameter is sized to be received within the closure base 76 as will be described in detail hereinafter. A lid locking flange is indicated generally at 82, the locking flange having, in this instance, a substantially planar upper surface which is inclined radially inwardly and downwardly from its periphery to provide an undercut or locking ring 83 which, in this instance, extends around the entire periphery of the locking flange. Although the locking flange is here illustrated as circular in configuration it will be understood that its configuration is not so limited, and any suitable configuration may be employed although a circular configuration minimizes binding during locking and unlocking of the lid from the locking flange.

A pouring or dispensing spout is indicated generally at 84 extending upwardly from the locking flange. The spout 84 includes a neck portion 86 which has an eye pleasing, upwardly curved contour and terminates, in this instance, in a top plate, 87 having a centrally located, circular dispensing aperture 88.

The closure lid 77 includes a central generally circular top plate 92 which moves from the closed position of FIGS. 16–18, 20, 21, 23 and 25 to a fully open position represented generally by FIG. 15 of the first embodiment. The lift tab 78 is integral with top plate 92 and, as will be noted from FIGS. 17, 19 20 and 21, does not extend beyond the external periphery of the closure assembly, though it could if desired or required. The top plate 92 is connected by the hinge assembly 79, which includes hinge plates 93, 94, to hinge base 95 which in turn is an integral horizontal extension of a vertical extension 96 from the circular base wall 97. The lid and hinge base form a top disposed on the closure base. A lid skirt, which extends approximately 240° about the circumference of the top plate 92, is indicated at 101.

Figure 26:
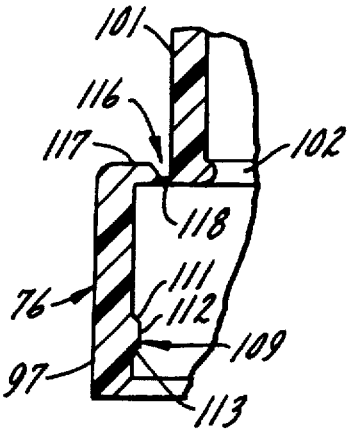
FIG. 26 is a partial section through the lid and base of the closure assembly illustrating particularly a tamper evident tab.
Figure 27:
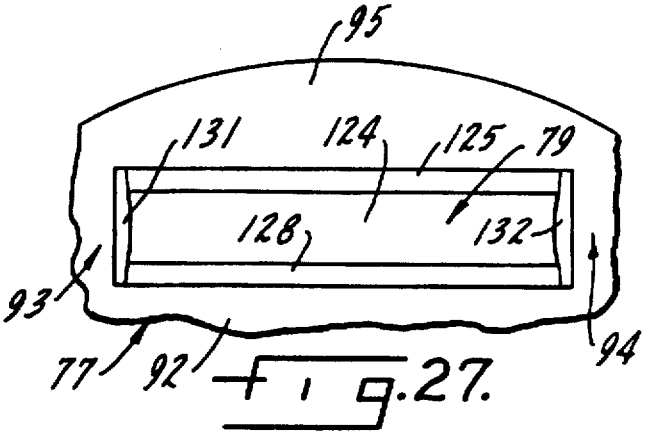
FIG. 27 is a plan view of a portion of the lid to an enlarged scale as shown in FIG. 17 illustrating particularly the hinge structure.

Locking means for ensuring that the closure lid 77 remains secured to the tube spout 84 is indicated at 102 in FIGS. 21 and 26. The locking means is a bead which is dimensioned to fit in the locking ring 83 formed beneath the lid locking flange 82. Preferably the locking bead 102 extends about 180° around the front of the circular base wall 97, though the actual extent may be lesser or greater. Preferably the length of the locking bead should not be so great as to cause a binding action between the bead and the locking flange 82 during locking and unlocking, and yet be of sufficient length so as to ensure that the two parts grip one another firmly.

Figure 23:
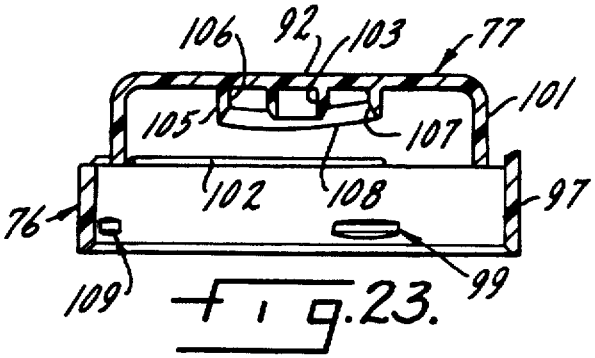
FIG. 23 is a section taken substantially along the line 23—23 of FIG. 17.
Figure 24:
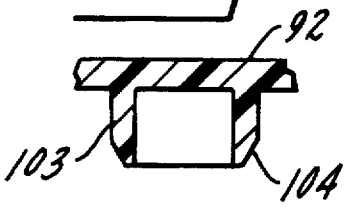
FIG. 24 is a section view of the interior spud taken to an enlarged scale as compared to the scale of FIG. 23.
Figure 25:
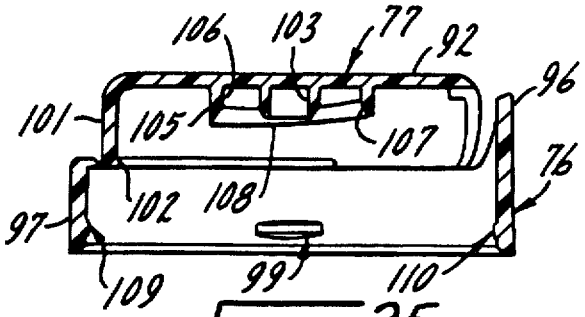
FIG. 25 is a section taken substantially along the line 25—25 of FIG. 17.

A double seal system for ensuring fluid tight engagement between the closure lid 17 and the dispensing spout 84 is illustrated in FIGS. 21 and 23–25. The first seal consists of a circular plug 103 which projects downwardly from the underside of top plate 92 and in alignment with the dispensing aperture 88 of the top plate. As best seen in FIG. 24, the lower circular end of the wall of plug 103 is tapered inwardly as at 104 in order to enable the plug 103 to cam past the upper corner of aperture 88 when the lid 77 is rotated in a downward, closing and sealing direction. The second seal consists of a circular ring 105 which projects downwardly from the underside of top plate 92 radially outwardly from plug 103, the ring 105 and that portion of the lid lying within it forming in effect a solid wall, closed bottom receptacle. The ring 105 is so dimensioned that its inner wall 106, see FIG. 23, slides along the exterior surface of the vertically upwardly extending portion of spout 84, said upwardly extending portion forming, in effect, a spud. As best seen in FIGS. 23 and 25, the lower circular inner wall end portion of ring 105 is tapered radially outwardly at 107 in order to enable the ring 105 to cam past the upper outer corner of the neck portion 86 of the spout when the lid 77 is rotated in a downward closing and sealing direction. It will be appreciated that the tapered surfaces 104 and 107 on the plug and ring ensure that there will be no undesirable binding between the lid and the spout when the lid is rotated downwardly into sealing engagement with the pouring spout. It will be noted that the double seal system is a seal within a seal system; that is, one seal completely surrounds and protects the other seal.

Means for ensuring that there will be no binding between the lid and the spout when the lid is moved toward a container open position of FIGS. 14 or 15 are also shown in FIGS. 21, 23 and 25, said means comprising decreasing the length of the lower end portion of ring 105 in a direction toward the hinge assembly 79. The full extent of the decrease in length is seen from a careful inspection of FIG. 21; it is more readily seen as represented by the bottom edge contour 108 in FIGS. 23 and 25.

Referring now to FIGS. 23 and 25, three of four snap-on lugs are indicated generally at 99, 109 and 110. Each snap-on lug consists of an upper inclined surface 111, which could be flat but, as shown, is preferably inclined slightly downwardly and inwardly, a vertical surface 112, and a lower downwardly and outwardly inclined surface 113, the three surfaces forming a projection which is snugly received in the locking ring 83 whose cross section is generally triangularly shaped as best seen in FIG. 21. It should be understood that the slant of the lower surface 113 matches the slant of the transition section 75, and the upper surface 111 fits snugly under the overhanging edge of top section 81. The upper slanted surface makes possible the removal of the closure assembly 72 from the container assembly 71 upon the application of sufficient force between the lower edge of the base wall 97 and the transition section 80. If there is little or no foreseeable need to disassemble the closure assembly from the container assembly during the normal life of the package, the upper surface 111 could be flat, though mold design considerations could still indicate the use of the illustrated slanted configuration.

The unique means for molding the closure assembly in a closed position are illustrated best in FIGS. 17, 29 and 26.

Referring first to FIG. 26, a tamper resistant member which joins the closure lid 77 to the closure base 76 is indicated generally at 116. The tamper resistant feature is a tab which is formed integrally with base wall 97 as best seen in FIG. 26. The tamper resistant tab includes a base section 117 which terminates in a thin strap 118 which joins the lower outer edge of lid skirt 101 to base wall 97. The strap 118 may, for example, be on the order of only about 0.006" in thickness and hence it forms a line of weakness which can be readily ruptured by the application of upwardly directed thumb pressure on lift tab 78, yet the tamper resistant tabs, of which two are shown in FIG. 17, are sufficiently strong to maintain the closure base 76 and the top plate 92 and its depending lid skirt 101 in the position of FIG. 26 during molding, including ejection, and subsequent handling and capping steps.

It will be noted that since the top plate 92 is oriented relative to the base wall 97 as shown in FIG. 17, engagement pressure for pushing the closure assembly 72 onto the container assembly 71 may be exerted on the upper exposed surface portions 114, 115 of base wall 97, and thus little pressure will be exerted on closure lid 77 which would be transmitted to the thin straps 118. As a result, the integrity of the straps 118 is maintained until the user, such as a consumer, proposes to use the package for the first time.

The unique concealed hinge feature of this invention is illustrated best in FIGS. 16–22 and 27.

Figure 22:
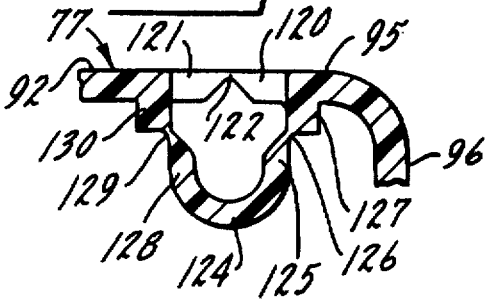
FIG. 22 is a partial section view through the hinge mechanism to an enlarged scale taken parallel to section line 21—21.

Referring first to FIGS. 16, 17 and, initially, to FIG. 22, which is a detailed view of the hinge portion of FIG. 21, but to a larger scale, it will be seen that the upper surface of the left hinge plate 93 is flush with the top surface of top plate 92 so that a smooth, aesthetically pleasing appearance is presented to the eye. Since hinge plates 93 and 94 are identical, only hinge plate 93 will be described. Hinge plate 93 includes a rear portion 120 and a front portion 121, the two portions tapering upwardly at the mid-portion of the hinge plate to define a bend line are 122. It will be understood that the material to the right of bend line area 122 (as viewed in FIG. 22) in FIGS. 16 and 21 is integral with, and forms a portion of, hinge base 95, and the material to the left of bend line area 122, as viewed in FIG. 22, is integral with, and forms a portion of, top plate 92.

The hinge assembly 79 includes a U shaped hinge 124 whose rear leg 15 terminates in a thin strap 176 which in turn is integral with depending rear base member 127 which is integral with hinge base 95. The front leg 128 of hinge assembly 79 terminates in a thin strap 129 which in turn is integral with the depending front base member 130 which is integral with the top plate 92. The left end and right end portions of hinge 124 are preferably cut away as at 131, 122, see FIGS. 17 and 27, to relieve any tendency for the hinge assembly to bind as it moves from a fully closed to a fully opened position, and back again.

The closure assembly 12 is illustrated in a fully closed position in FIGS. 16–21, 23 and 25. This is the position in which the closure assembly is molded and snapped onto container assembly 71 prior to the first use of the package.

Of particular importance is that the hinge assembly 79 is located almost on the periphery of the area covered by the closure lid 77 and the hinge base 95. This is accomplished by using the thinnest possible hinge plates 93, 94 and locating the U shaped hinge 124 as close to the circle defined by the inner surface of the closure based wall 97 as possible. Specifically, the outermost corners 132, 133 of the hinge assembly opening formed between the hinge base 95 and the lid 92 lie on, or almost on, the outermost extremity of the horizontal area of the closure lid which, in this instance, is the circle defined by the inner surface of the closure base wall 77 when projected upwardly to the circular area defined by the hinge base 95 and lid 92.

Further, the hinge plates 93, 94 are of minimum width. They are for example only about ½ the width of the corresponding hinge plates 33, 34 in the embodiment of FIGS. 1–15. The only requirement of the width of the hinge plates is that they be sufficiently wide, and thick, to withstand, without operative degradation, the number of flexings which will occur over the life of the package. It will be understood that the packages with which this invention is concerned are intended to be single use packages in the sense that they are not intended to be refilled, and are discarded after their contents are exhausted. Having in mind these parameters it will be appreciated that, using conventional resins, the width of the hinge plates 93, 94 may be on the order of about 1/16 of an inch when the package is applied to consumer products intended to be used in the home.

A further distinct advantage of the remote setback of the hinge assembly relative to the periphery of the closure lid is that the maximum (for a top located concealed hinge) radius of swing is provided. Hence the closure lid will unlock and flip upwardly with less force than would otherwise be the case in constructions in which the hinge assembly is located well off the circular periphery, such as the construction illustrated in the embodiment of FIGS. 1–15.

It will also be noted that the embodiment of FIGS. 16–27 provides a double seal, if desired, to prevent leakage of the contents. Since the closure assembly is composed of currently used resins and hence has substantial deformation and yieldability capabilities whenever external forces are imposed thereon, a first seal will be formed between the abutting outer surface of plug 103 and the inner surface of the dispenser aperture 88, and a second seal will be formed between the abutting inner surface of second plug 105 and the vertical outer surface of spout 84. If desired, either one of said seals may be omitted if the end use conditions only require a single seal as would be the case with axle grease, for example. In all probability if only one seal were employed it would usually be the plug 103, and the second plug 105 would be eliminated.

It will thus be seen that a unique closure assembly, and a closure assembly in combination with a container assembly to form a package, has been disclosed in which a smooth exterior periphery is provided, together with a concealed internal hinge which provides a smooth upper surface. At the same time, the closure assembly may be molded in a closed position thereby reducing dramatically the cost of production.

It will be understood that, although a specific embodiment has been illustrated and described, modifications and changes may be made within the spirit and scope of the invention. Accordingly, it is intended that the scope of the invention be limited solely by the hereafter appended claims, when interpreted in light of the relevant prior art, and not by the foregoing exemplary description.

We claim:

1. In combination in a package, a container assembly, said container assembly having an upper end portion thereof adapted to be connected with a closure assembly, a closure assembly, said closure assembly having means for connecting said closure assembly to the upper end portion of the container assembly to form a package, said closure assembly including a base and a lid which is movable between an opened position which provides access to the contents of the container assembly and a closed position which blocks access to the contents of the container assembly, said lid being connected to the base of the closure assembly by hinge means, said hinge means being located within the outer periphery of the closure base whereby no portion of the hinge means extends outwardly beyond the periphery of the closure base, said hinge means being located beneath the upper surface of the lid, said hinge means including a pair of hinge plates which flank a generally U shaped hinge, said hinge plates defining a bend line which lies substantially in the surface of the lid and is parallel to the axis of the U shaped hinge, the outermost corners of said hinge plates lying substantially on the outermost extremity of a horizontal area of the lid.

2. The package of claim 1 further characterized in that the lid includes first seal means arranged to block aperture means in the associated container assembly so as to seal off communication between the interior of the container assembly and the atmosphere.

3. The package of claim 2 further characterized in that said lid carries means for forming a second seal with the associated container assembly so as to seal off communication between the container assembly and the atmosphere, said first seal means and said means for forming a second seal means, when in operative engagement with the container assembly, being arranged to form a seal within a seal system.

4. The package of claim 3 further characterized in that said aperture means are formed in a spout at the upper end of the container assembly, said spout forming a spud, said lid including a receptacle arranged to receive the spud formed by the spout in abutting engagement around the entire outer periphery of the spud and the entire inner periphery of the receptacle.

5. The package of claim 4 further characterized in that the depth of the receptacle at the location most remote from the hinge means is greater than the depth of the receptacle at the location closest to the hinge means, whereby binding between the seal means carried by the lid and container assembly is minimized.

6. The package of claim 1 further characterized in that the width of the hinge plates is on the order of about 1/16th inch.

7. The package of claim 6 further including lid locking flange means carried by the container assembly and locking bead means carried by the lid, said locking flange means and lid locking bead means being arranged to engage when the container assembly is sealed by the closure assembly.

8. The package of claim 7 further characterized in that the lid locking flange means and the lid locking bead means are arranged to produce an audible signal when they lock together.

9. A closure assembly for a container assembly, said closure assembly having means for connecting said closure assembly to a container assembly to form a package, said closure assembly including a lid and a closure base, said lid being movable between an opened position which provides access to an associated container assembly and a closed position which blocks access to the container assembly, said lid being connected to the closure base by hinge means, said hinge means being located within the outer periphery of the closure base whereby no portion of the hinge means extends outwardly beyond the periphery of the closure base, said hinge means being located beneath the upper surface of the lid, said hinge means including a pair of hinge plates which flank a generally U shaped hinge, said hinge plates defining a bend line which lies substantially in the surface of the lid and is parallel to the axis of the U shaped hinge, the outermost corners of said hinge plates lying substantially on the outermost extremity of a horizontal area of the lid.

10. The closure assembly of claim 9 further characterized in that the lid includes first seal means arranged to block aperture means in the associated container assembly so as to seal off communication between the interior of the container assembly and the atmosphere.

11. The closure assembly of claim 10 further characterized in that said lid carries means for forming a second seal with the associated container assembly so as to seal off communication between the container assembly and the atmosphere, said first seal means and said means for forming a second seal means, when in operative engagement with the container assembly, being arranged to form a seal within a seal system.

12. The closure assembly of claim 11 further including snap-on means carried by the lid for snapping the lid onto a container assembly with which the closure assembly is to be associated.

13. The closure assembly of claim 12 further characterized in that the snap-on means is arranged to snap connect to flange means carried by the container assembly.

* * * * *